US006796265B1

(12) United States Patent
Dexter et al.

(10) Patent No.: US 6,796,265 B1
(45) **Date of Patent: *Sep. 28, 2004**

(54) PNEUMATIC SIGNALING DEVICE FOR DIVERS

(75) Inventors: James T. Dexter, Huntington Beach, CA (US); David A. Hancock, Seattle, WA (US)

(73) Assignee: Ideations Design, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/461,715

(22) Filed: Jun. 16, 2003

Related U.S. Application Data

(63) Continuation of application No. 09/976,337, filed on Oct. 15, 2001, now Pat. No. 6,578,511.

(60) Provisional application No. 60/241,853, filed on Oct. 20, 2000.

(51) Int. Cl.[7] ..... G08B 3/06

(52) U.S. Cl. ..... 116/137 R; 116/140; 116/142 R; 116/142 FP

(58) Field of Search ..... 116/137 R, 138, 116/140, 142 FP, DIG. 7, 70, 67 R; 137/625.47

(56) References Cited

U.S. PATENT DOCUMENTS

| | | | | |
|---|---|---|---|---|
| 3,144,171 A | | 8/1964 | Gagnan et al. | 116/70 |
| 3,277,437 A | | 10/1966 | Bouyoucos | 340/12 |
| 3,433,202 A | | 3/1969 | Sharp et al. | 116/27 |
| 3,633,621 A | * | 1/1972 | Myers | 137/625.11 |
| 3,704,651 A | | 12/1972 | Kupka | 91/232 |
| 3,734,132 A | * | 5/1973 | Kuhnelt | 137/625.49 |
| 3,785,335 A | | 1/1974 | Wagner | 116/112 |
| 3,895,561 A | | 7/1975 | Felderhof et al. | 91/20 |
| 4,045,835 A | | 9/1977 | Flam et al. | 9/313 |
| 4,095,667 A | | 6/1978 | Mahig et al. | 181/120 |
| 4,852,510 A | | 8/1989 | Joseph, Jr. et al. | 116/140 |
| 4,893,580 A | | 1/1990 | Joseph et al. | 116/137 R |
| 4,950,107 A | | 8/1990 | Hancock et al. | 405/186 |
| 4,998,499 A | | 3/1991 | Nordbeck | 116/142 |
| 5,022,790 A | | 6/1991 | Stevenson | 116/142 FP |
| 5,102,236 A | | 4/1992 | Hancock et al. | 116/142 FP |
| 5,355,830 A | | 10/1994 | deJong | 116/142 FP |
| 5,951,205 A | | 9/1999 | Chen | 405/186 |
| 5,988,220 A | | 11/1999 | Sakaki | 137/625.47 |
| 6,253,791 B1 | | 7/2001 | Miklo | 137/625.47 |

FOREIGN PATENT DOCUMENTS

| | | |
|---|---|---|
| AU | 413 441 | 10/1967 |
| FR | 827 206 | 9/1937 |
| FR | 898 967 | 6/1943 |
| GB | 1 330 414 | 9/1973 |
| GB | 1 362 213 | 7/1974 |
| GB | 1 389 068 | 4/1975 |

* cited by examiner

*Primary Examiner*—Diego Gutierrez
*Assistant Examiner*—Amanda J Hoolahan
(74) *Attorney, Agent, or Firm*—McGinn & Gibb, PLLC

(57) ABSTRACT

The present invention relates to an all-purpose, pneumatic powered signaling device including a first component capable of transmitting signals above water and a second component capable of transmitting a signal beneath the water. The first component includes a pneumatic air horn and the second component a diaphragm and piston. A button actuator is selectively depressed to create a flow passageway from a source of compressed air to the first and second components. A selector switch is selectively adjustable to allow a stream of compressed air flowing through the passageway to enter either the first or the second component and transmit a signal above or below the water.

14 Claims, 14 Drawing Sheets

PNEUMATIC SIGNALING DEVICE FOR DIVERS

RELATED APPLICATIONS

The present invention is a Continuation of Ser. No. 09/976,337, which was filed on Oct. 15, 2001, and which issues as U.S. Pat. No. 6,578,511 on Jun. 17, 2003. U.S. Ser. No. 09/976,337 claims priority from Provisional Patent Application on Provisional Patent Application No. 60/241,853, which was filed on Oct. 20, 2000, which is incorporated herein by reference for all purposes.

BACKGROUND OF THE INVENTION

The present invention relates to a signaling apparatus. More particularly, the present invention is directed to an all-purpose, pneumatic powered signaling device adaptable for effectively transmitting signals above and below water.

It is well known that divers may use one or more tanks of compressed air to extend their time beneath the surface of the water. Such divers, often referred to as "scuba" (self-contained, underwater, breathing apparatus) divers, would benefit greatly if they were able to communicate with other divers below the water's surface. It would also be desirable for scuba divers to be able to communicate with others when they return to the surface of the water. It would be ideal if one device could be used for both purposes.

U.S. Pat. No. 4,950,107 to Hancock et al., which patent is incorporated herein by reference in its entirety, discloses an audible alarm device for divers. More specifically, the audible alarm device consists of a pneumatically operated horn activated by a push button. The air source for the audible alarm device is a tap off the line from a scuba tank to a buoyancy compensator vest. While the audible alarm device is well suited for attracting the attention of others once the diver has surfaced, it is of little or no use while the diver is submerged.

Effective underwater signaling from one diver to another is normally performed with a percussion device of some description. For example, U.S. Pat. No. 5,400,736 to Gold discloses a hand-operated signaling device while U.S. Pat. No. 4,095,667 to Mahig et al. and U.S. Pat. No. 5,302,055 to Johnson disclose pneumatically operated pistons which impact on a diaphragm. It will be appreciated that in the later patents, the mechanical impact of the piston on the diaphragm permits the diaphragm to vibrate or reverberate, thus creating a pressure wave that can be heard/felt by other submerged divers.

Thus, pneumatic signaling devices, which work in either air or water, are known. Several attempts have been made to fabricate an all-purpose signaling device. For example, U.S. Pat. No. 4,998,499 to Nordbeck discloses a pneumatic signaling device designed to operate both above and below the water. More specifically, the '499 patent employs a vibrating diaphragm inducing impulses in an attached air horn; the diaphragm and air horn can operate underwater by virtue of a lid, which lid can be detached from the signaling device when operating in air. In contrast, U.S. Pat. No. 4,852,510 to Joseph et al, which discloses a scuba whistle, which can be operated both above and below the surface of the water.

However, manufacturers have not been able to design a pneumatic signaling devices that works "equally" well in air and water for a number of reasons. For example, air horns that operate above the water are generally inoperable beneath the water. For the sound generated by such air horns to carry any distance, it is necessary to employ a source of compressed air, which air source is conventionally carried as part of the horn assembly. Likewise, conventional whistles and bells are limited to signaling above water and are both cumbersome to carry and of limited range. Alternatively, it is known that when a piston impacts against a diaphragm, a percussion wave is created that will transmit above and below water. While a percussion wave may be felt some distance underwater, such devices are generally unsatisfactory for transmitting signals above water. Furthermore, there exists the need of providing a readily available source of compressed air capable of powering the piston. Moreover, even if the same source of compressed air can be employed to power air horn and piston signaling devices, the optimum mass flow rate of air needed to operate a pneumatic piston signaling device is substantially greater than that needed to operate an air horn signaling device.

It is clear that there exists a need in the art for an improved signaling device equally adaptable for effectively transmitting signals above and below water. Such a device should be as small as possible and, preferably, not require a separate compressed air power source that could add weight and inhibit movement of a diver. Preferably, the signaling device would be adaptable to employ a diver's own source of compressed breathing air. As will become apparent, the present invention provides an all-purpose signaling device capable of utilizing a scuba diver's air supply to power the device to transmit signals above and below the water.

SUMMARY OF THE INVENTION

There is a critical need in the art for an all-purpose signaling device that divers can utilize above as well as below the surface of the water.

The present invention is directed to an all-purpose, pneumatic powered signaling device that can readily be used to signal others above and below the water. The device employs a selector switch capable of directing a stream of compressed air to either a first component for signaling above water or to a second component for signaling under water. The all-purpose pneumatic signaling device is preferably integrated into the air flow passageway leading from a diver's source of compressed breathing air, i.e., breathing tank, and the diver's buoyancy compensator device for powering the buoyancy compensation system. When the selector switch is set for above water use and the signaling device is activated, compressed air from the diver's tank at a first flow rate is directed into an air horn for generating an audible signal through the air. Alternatively, when the selector switch is set for below water use and the device is activated by the diver, compressed air at a second flow rate is directed into an enclosed cylinder and functions to drive a piston into repeated impact against a rigid diaphragm, causing the diaphragm to oscillate and transmit a percussion signal wave through the water which can be heard, i.e., felt, by other divers in the vicinity.

A significant advantage of the present invention resides in the ability to actuate the all-purpose signaling device by merely twisting or moving a selector knob to "set" the device in either the above or under water mode of operation. The signal can then be initiated by merely pressing an actuator button. The signaling device may be "set" for underwater transmission before the diver proceeds underwater or may be "set" immediately prior to use. When the diver returns to the surface, he may rotate the selector switch to "set" the device for air transmission.

Because the underwater component of the all-purpose signaling device includes only the single moving piston, there is little chance of the device malfunctioning regardless of the depth at which the device is employed. There is also no need for the diver to repeatedly depress the actuator button to continue to transmit a signal. A unique system of air flow passageways extending within the cylinder directs the flow of compressed air to sequentially propel the piston against the diaphragm or move the piston out of contact with the diaphragm before automatically initiating another cycle. As a result, one depression of the actuator button is sufficient to transmit periodic percussion waves that may be "heard" by other divers in the vicinity.

Advantageously, the present invention employs a quick-disconnect attachment assembly for joining the signaling device to a diver's existing airflow system, which permits the signaling device to be easily connected and disconnected in the air line between the diver's air tank and the diver's buoyancy compensation system via a power inflator. This allows compressed air to continue to pass uninterrupted from the diver's tank to the power inflator while, at the same time, permitting a small portion of the compressed air to be rerouted to selectively initiate either an above or below water signal.

According to one aspect, the present invention provides a pneumatic signaling device operable above and below the surface of the water from a source of compressed gas. Preferably, the pneumatic signaling device includes a continuous signaling device for generating a continuous signal detectable above the surface of the water operated at a first flowrate, a percussion signaling device for generating an intermittent signal detectable below the surface of the water operated at a second flowrate greater than the first flowrate, and a device for selecting an orifice sized to produce one of the first and second flowrates. If desired, the selecting device is disposed downstream of the percussion signaling device. In an exemplary case, the percussion signaling device includes a single moving element, which advantageously can be a bi-stable undamped piston.

According to another aspect, the present invention provides an all-purpose signaling device including a first signaling component operable at a first flowrate, a second signaling component operable at a second flowrate, a selector switch assembly for selectively creating one of first and second flow passageways sized to permit flow of compressed gas at the first and second flowrates, respectively, and an actuator which provides the compressed gas to the selector switch, wherein the first flowrate is less than that needed to operate the second signaling component. If desired, the first component can include a gas driven horn adaptable for transmitting audible sounds above water while the second component can include a device for creating a percussion wave signal that travels underwater. More specifically, the percussion device includes a cylinder having a longitudinal bore accepting a bi-stable piston and a diaphragm disposed across an open end of the longitudinal bore.

In the all-purpose signaling device discussed immediately above, the piston includes a driven end which impacts the diaphragm and a driving end opposite the driven end, the driving end of the piston is larger in diameter than the driven end of the piston, the cylinder includes an inlet port and an exhaust port disposed on opposite sides of the driving end of the piston, and movement of the driving end of the piston away from the diaphragm between first and second predetermined positions simultaneously closes the exhaust port in the cylinder to thereby permit pressure buildup proximate to the driving end of the piston and opens a bypass passageway permitting the compressed gas from the inlet port to contribute to the pressure buildup.

Furthermore, in the all-purpose signaling device mentioned immediately above, the selector switch assembly includes a selector cup with at least two attached leg members adaptable for joint rotation with the cup, wherein only one of the legs is positioned adjacent a flow inlet of one of the first and second signaling components when the cup is in a first predetermined position and wherein only the other of the legs is positioned adjacent a flow inlet of the other of the first and second signaling components when the cup is in a second predetermined position. If desired, a separate curved member can be mounted on each leg for selectively blocking one of the flow inlets when positioned adjacent thereto.

According to a further aspect, the present invention provides a pneumatic signaling device operable by compressed gas including a continuous signaling device operable at a first flowrate of the compressed gas, a percussion signaling including a single moving element and operable at a second flowrate of the compressed gas greater than the first flowrate, and a control device including a moveable member which permits operation of a selected one of the continuous signaling device and the percussion signaling device. Preferably, movement of the moveable member between first and second positions selects between the first and second flowrates required to operate the continuous and the percussion signaling devices, respectively, while positioning the moveable member to a third position establishes the selected one of the first and second flowrates. If desired, the continuous signaling component can be a gas driven horn. Preferably, the single moving element comprises a bi-stable piston. In an exemplary case, the bi-stable piston is disposed in a cylinder providing air passageways permitting undamped operation of the bi-stable piston. Advantageously, the moveable member is rotatable between the first and second positions while the moveable member permits movement to the third position irrespective of whether the moveable member starts from the first position or the second position.

BRIEF DESCRIPTION OF THE DRAWINGS

The various advantages of the present invention will become apparent to one skilled in the are by reading the following specification and by reference to the following drawings in which.

DETAILED DESCRIPTION OF THE PREFERRED EMBODIMENTS

Figure 1:
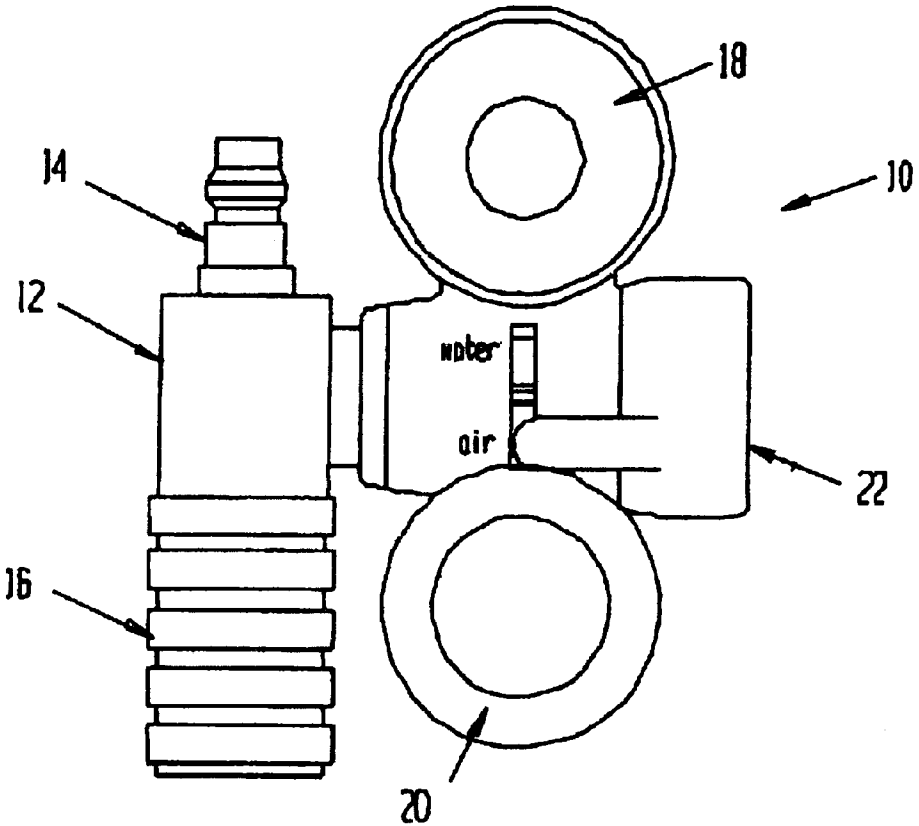
FIG. 1 is a front elevation of an all-purpose pneumatic powered signaling device formed in accordance with the present invention.
Figure 2:
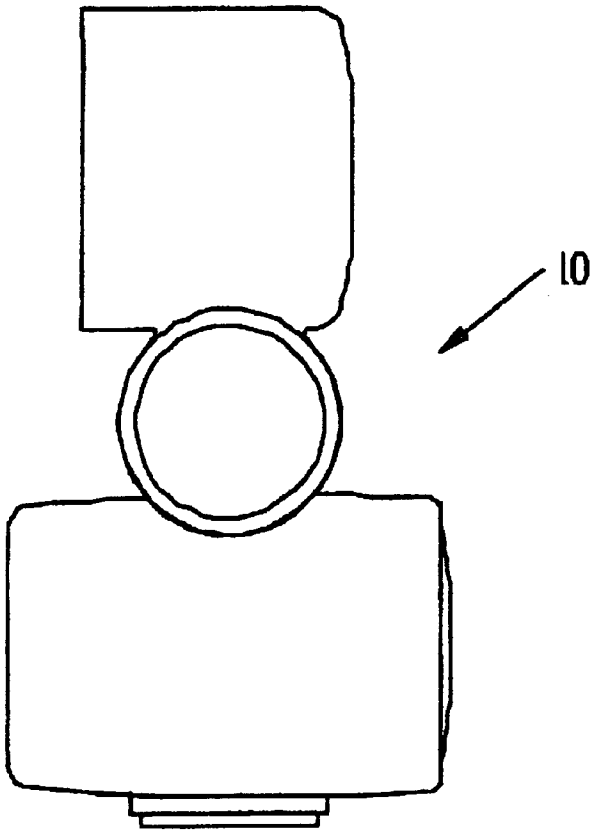
FIG. 2 is a side view of the signaling device of FIG. 1 formed in accordance with the present invention.

Illustrative embodiments and exemplary applications are described below with reference to the accompanying drawings in order to disclose the advantageous teachings of the present invention. Referring now to the drawings, wherein like reference numerals designate like elements throughout, an all-purpose, pneumatic powered signaling device is shown in front elevation in FIG. 1 at 10.

The pneumatic signaling device 10 according to the present invention is uniquely designed to allow for quick connect and disconnect without modification of a diver's existing compressed air equipment. Signaling device 10 includes a quick disconnect body 12 adaptable for releasable attachment to a pair of air couplings 14 and 16, respectively. Air coupling 14, in turn, is connectable to a low-pressure air hose, not shown, which may be attached to the air tank of a conventional scuba diving apparatus. Air coupling 16 may be connected to a diver's power inflator, also not shown, for operating the diver's buoyancy compensation system. While air-coupling 14 is shown as a male type coupling and air coupling 16 is a female type coupling, it will be appreciated that this is an arbitrary selection. Thus, it will be appreciated that the air coupling 14 could be a female type coupling and air coupling 16 could be a male type coupling. The actual choice will most likely be driven by the configuration of the diver's buoyancy compensation system.

All-purpose signaling device 10 includes an above water signaling component 18, a below water signaling component 20 and an integrated selector switch and actuator assembly 22 disposed for selectively directing a stream of compressed air to either of the components 18 or 20. Stated another way, the pneumatic signaling device includes a selector device which permits one of first and second predetermined flow rates of a compressed gas, e.g., air, to be applied to at least one of the above water signaling component 18 and the below water signaling component 20, respectively. The selector device preferably is located upstream of both signaling components 18 and 20; it will be appreciated that the selector device advantageously can be located anywhere so long as the single selector device is capable of selecting between and/or controlling the air at the first and second predetermined flow rates.

Figure 3A:
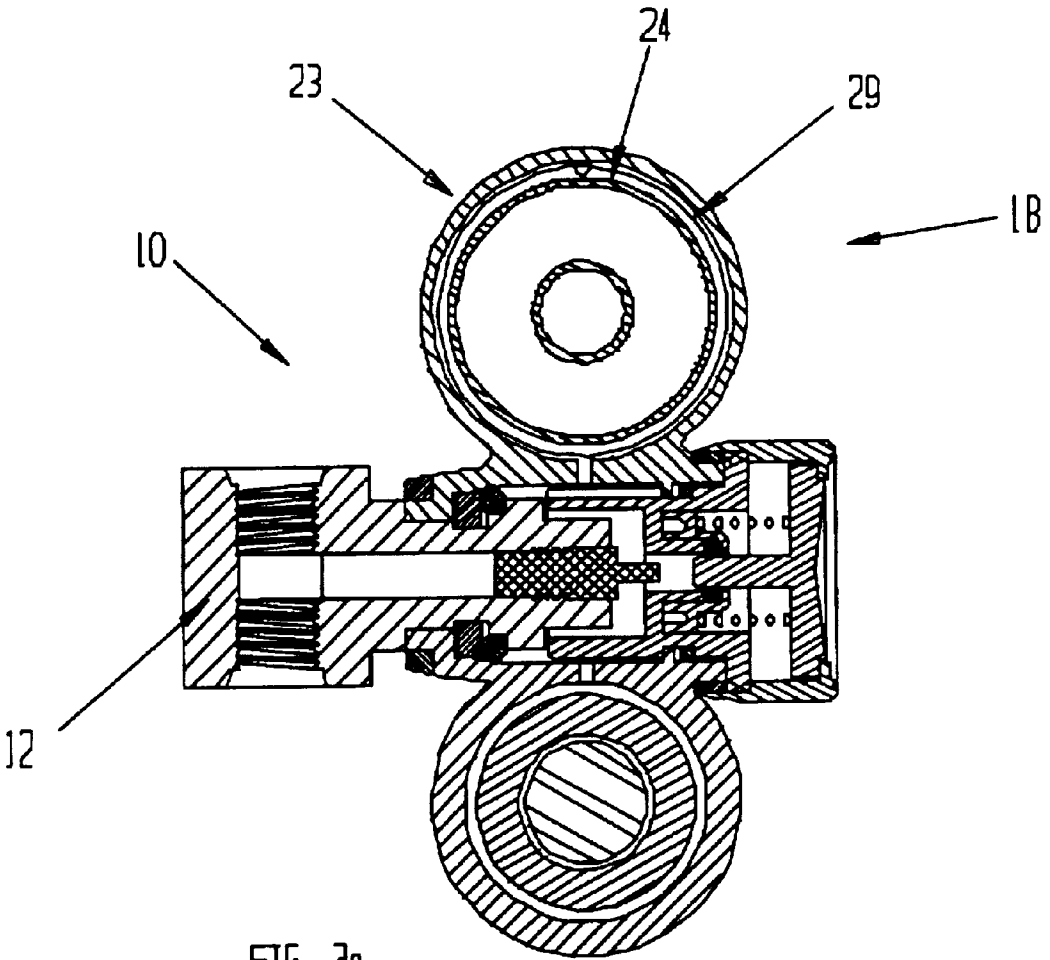
FIG. 3*a* is a sectional view of the signaling device of FIG. 1, with the air couplings removed and the device set for underwater signaling.
Figure 4A:
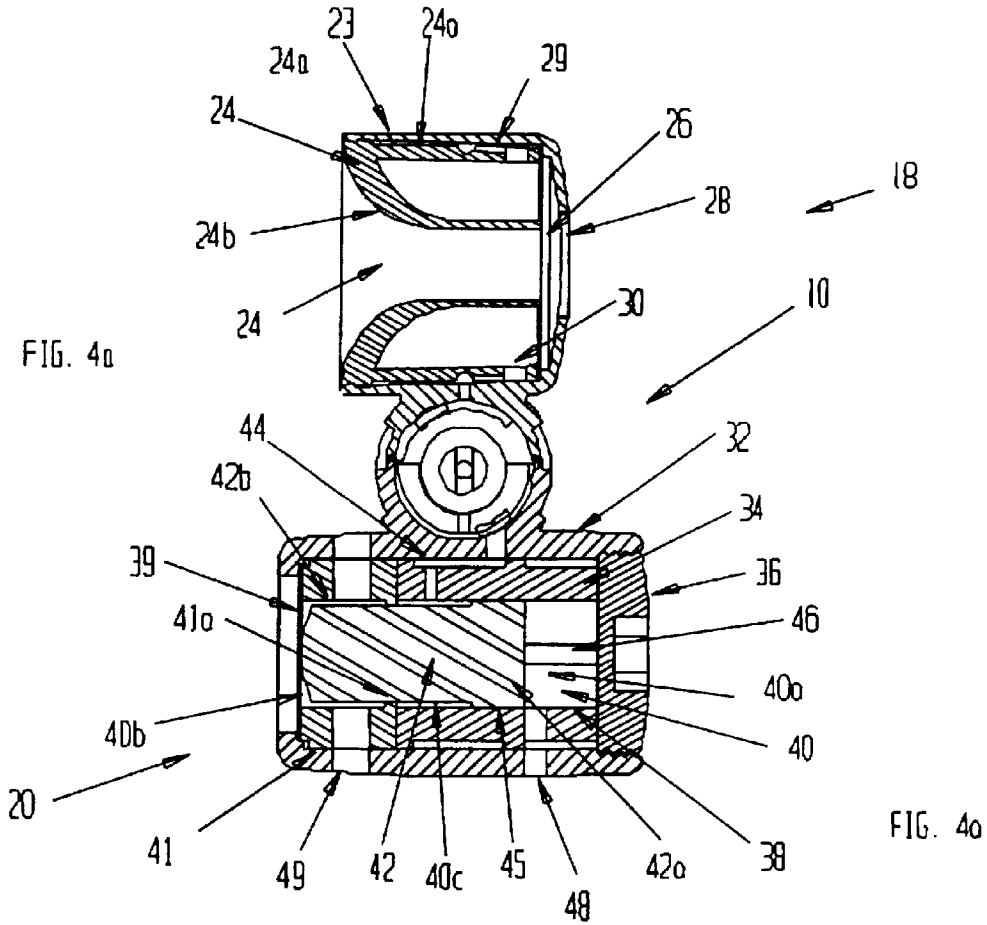
FIG. 4*a* is a sectional view of the signaling device of FIG. 2, with the device set for underwater signaling.
Figure 4B:
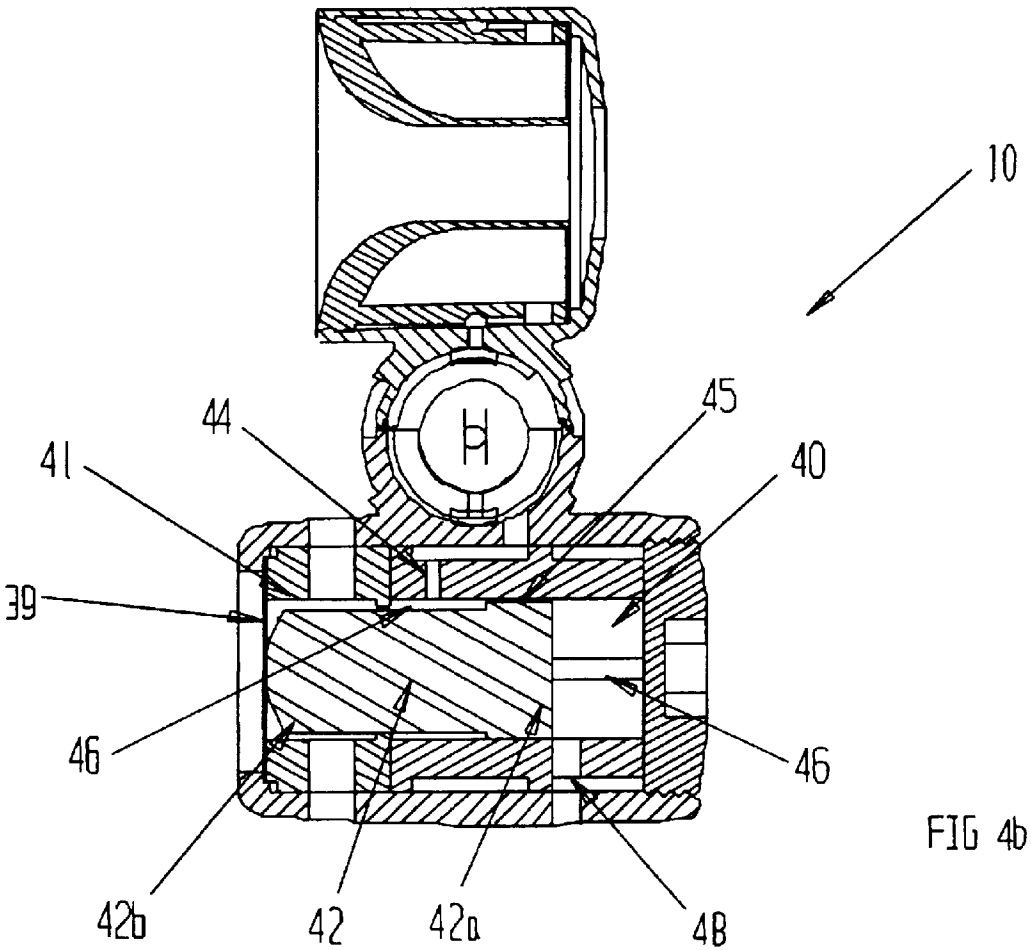
FIG. 4*b* is a sectional view of the signaling device of FIG. 2, with the device set for above water signaling.

The above water signaling component 18 is shown in detail in FIGS. 3*a* and 4*a*. In the exemplary preferred embodiment illustrated in FIGS. 3*a* and 4*a,* the signaling component 18 is a pneumatic air horn 18 that advantageously includes a substantially cylindrically-shaped, open ended chamber 23 encircling and supporting a horn bell assembly 24, which includes a cylindrical outer wall portion 24*a* and a curved inner wall portion 24*b.* A thin diaphragm 26 is disposed within the closed end of chamber 23, preferably in close proximity to wall portions 24*a* and 24*b,* respectively. An access or vent opening 28 is formed in the closed end of cylindrical chamber 23. An air flow passageway 29 encircles a portion of horn 24 and joins an opening 30 extending through the outer wall portion 24*a,* allowing compressed air to enter the space between wall portions 24*a* and 24*b* and impact diaphragm 26, creating an audible signal.

It will be appreciated that the vent opening 28 permits water to quickly drain from chamber 23. It will also be appreciated that diaphragm 26 is accessible for maintenance or replacement. Additional details regarding the pneumatic air horn of the pneumatic signaling device according to the present invention can be found in the aforementioned U.S. Pat. No. 4,950,107 to Hancock et al. Finally, it should be noted that while the exemplary embodiment employs a pneumatic air horn type signaling device, the invention is not so limited; other types of above water signaling devices, e.g., a pneumatically operated whistle, advantageously can be employed in the pneumatic signaling device 10 without departing from the spirit and scope of the present invention.

Figure 3B:
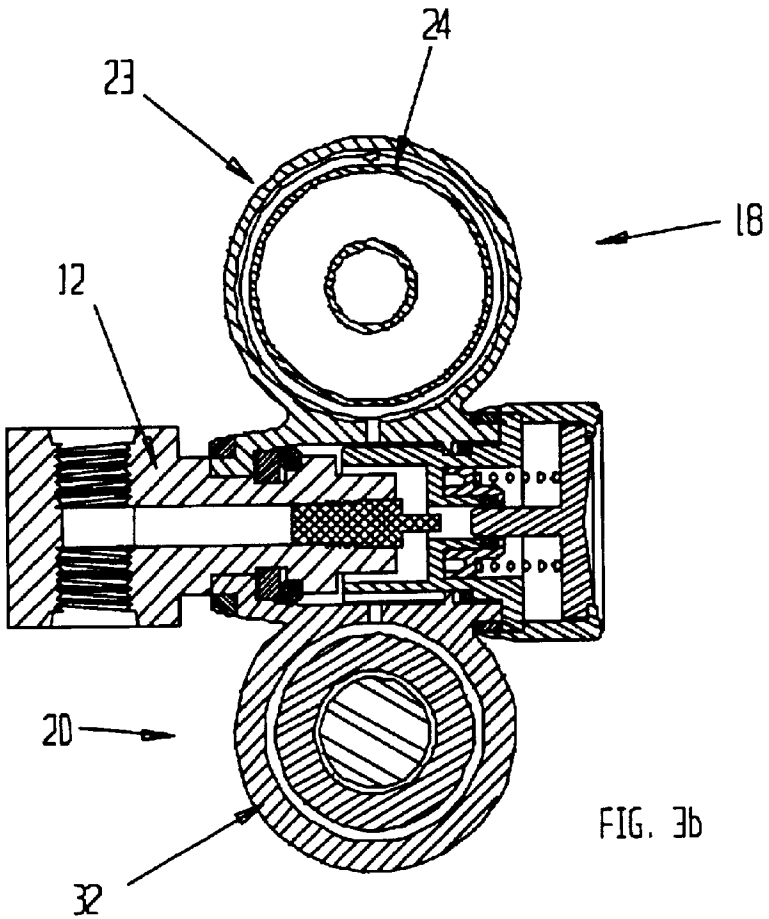
FIG. 3*b* is a sectional view of the signaling device of FIG. 1, with the air couplings removed and the device set for above water signaling.

The underwater signaling component 20 of signaling device 10 shown in FIGS. 3*b* and 4*a* advantageously comprises a bi-stable, undamped piston device, the operation of which will be discussed in detail below. The piston 42 can be formed from any suitable hard plastic or metal; one suitable material is an acetal thermal plastic. In an exemplary case, the signaling component 20 includes a cylindrical housing (cylinder) 32, which is open on one end, the open end being plugged, in turn, by a sleeve 34. Sleeve 34, in turn, includes circular end wall 36 attached to a cylindrical wall portion 38 and making fluid tight contact with the inner wall surface of cylinder 32. Sleeve 34 advantageously can be press fit into the cylinder 32. Sleeve 34 is preferably located at one end of cylinder 32 and advantageously can be separately formed from cylinder 32. Alternatively, cylinder 32 and sleeve 34 may be integrally constructed. A rigid diaphragm 39 encloses an opposite end of cylinder 32 from sleeve 34. The sleeve 34 is maintained a predetermined distance from the diaphragm 39 by a bushing 41.

It will be appreciated that the interior surfaces of diaphragm 39, bushing 41, and sleeve 34 define a fluid chamber 40. Advantageously, a solid piston 42 of generally cylindrical configuration is disposed within fluid chamber 40 for reciprocal movement therein. A rear or driving portion 42*a* of piston 42 includes a shoulder or land 45 of slightly larger diameter than the remainder of piston 42; the shoulder 45 is disposed at the transition between the driving portion 42*a* and the remainder of the piston 42. It will be appreciated that the driving portion 42*a* makes substantially fluid tight, sliding contact with the inner surface of the cylindrical wall 38 of sleeve 34. It will be appreciated that piston 42 advantageously includes a forward portion 42*b* in sliding, generally fluid tight contact with a bearing mechanism 41*a* of bushing 41; thus, the driven portion 42*a* is approximately equal in length to the length of the bushing 41. It will also be appreciated that the bearing mechanism 41*a* advantageously can be integrally formed with the 41 bushing.

It will be appreciated that the cylindrical wall 38 and the piston 42 define an annular chamber 40*c,* which is bounded by shoulder 45 of piston 42 and bearing mechanism 41*a*. It will also be appreciated that the volume of the annular chamber 40*c* varies based on the position of the piston 42 in the fluid chamber 40. An air flow inlet port 44 extends completely through cylinder 32 and cylindrical wall 38 of sleeve 34 and discharges into annular chamber 42*c*. An exhaust port 48 vents the driving end 40*a* of fluid chamber 40; a vent port 49 vents the driven end 40*b* of fluid chamber 40. The sleeve 34 advantageously includes a slot or groove 46, which extends axially along the sleeve 34 between the end wall 36 and the vicinity of air flow inlet 44. It will be appreciated that the groove 46 is proximate to the driving end 42*a* of the piston 42. As will be explained, compressed air may selectively be allowed to enter annular chamber 40*c* through inlet 44 and, when the position of the piston 42 permits, exit the underwater signaling component 20 via the port 48. When the path 40*c,* 46, 40*a,* and 48 is not available, air can blow by the bearing mechanism 41*a* into forward portion 40*b* of fluid chamber 40 and exhaust via port 49.

Figure 6A:
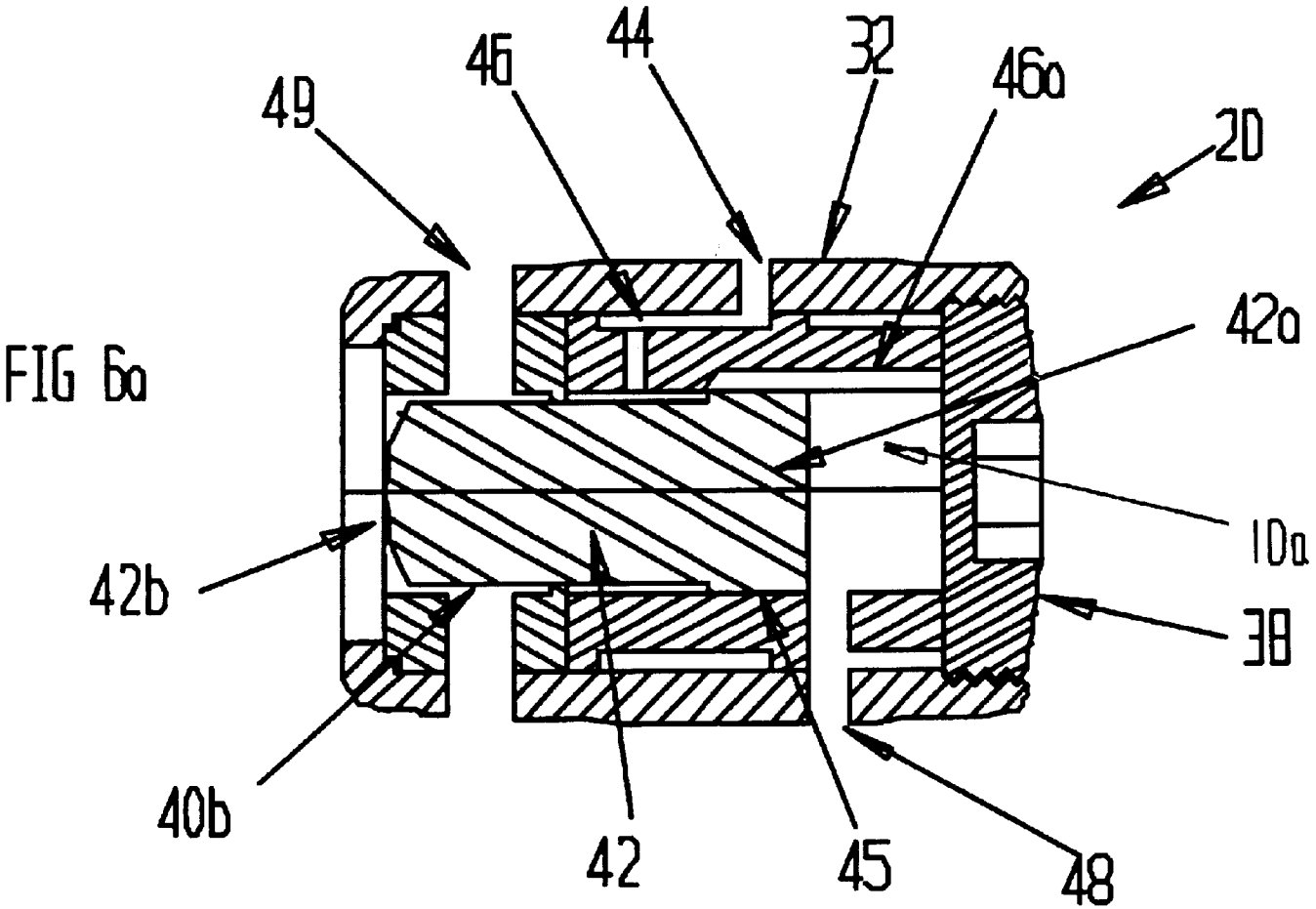
FIGS. 6*a*, 6*b* and 6*c* each shows a sectional view of a portion of the signaling device of FIG. 4*a* at different intervals of operation of the device according to the present invention.

It will be appreciated that the port 48 extends through both cylinder 32 and the cylindrical wall 38 of sleeve 34, forming a fluid connection with rear portion 40*a* of fluid chamber 40. It will also be appreciated that the port 49, which is best seen in FIGS. 6*a,* 6*b,* and 6*c* extends through cylinder 32 and bushing 41 to a forward portion 40*b* of fluid chamber 40, which is bounded by bushing 41, piston 42 and rigid diaphragm 39. It should be mentioned at this point that the driven end 42*b* of piston 42 may be rounded for better interaction with diaphragm 39 in a manner that will become clear.

Referring now to FIGS. 6*a,* 6*b,* and 6*c,* the operation of the underwater signal component 20 of the all-purpose signaling device 10 will now be explained. Solely for the purposes of explanation, assume piston 42 is in its most forward position in fluid chamber 40 as shown in FIG. 6*a*. When a stream of compressed air is introduced into inlet port 44, the air will flow into annular chamber 40*c,* thus applying pressure to shoulder 45 of driving end 42*a* of piston 42 and causing piston 42 to begin to move away from diaphragm 39 in the direction of end wall 36 of sleeve 34. Once piston 42 starts to move, a previously covered portion of longitudinal groove 46 is exposed by the movement of driving end 42*a,* which fluidly couples the annular chamber 40*c* with the end portion 40*a* of fluid chamber 40, permitting air to displace any fluid occupying portion 40*a* of fluid chamber. It should be mentioned that ports 48 and 49 are open to the environment, i.e., in order to minimize the pressure drop across the ports, there are no back flow prevention devices, e.g., check valves, installed. Thus, as least during initial operation, the either or both of portions 40*a* and 40*b* of fluid chamber 40 can be at least partially filled with water. It will be noted that the terminology "fluid chamber" was selected to reflect the fact that the interior surfaces of the underwater signaling device 20 are permitted to be wetted.

Figure 6B:
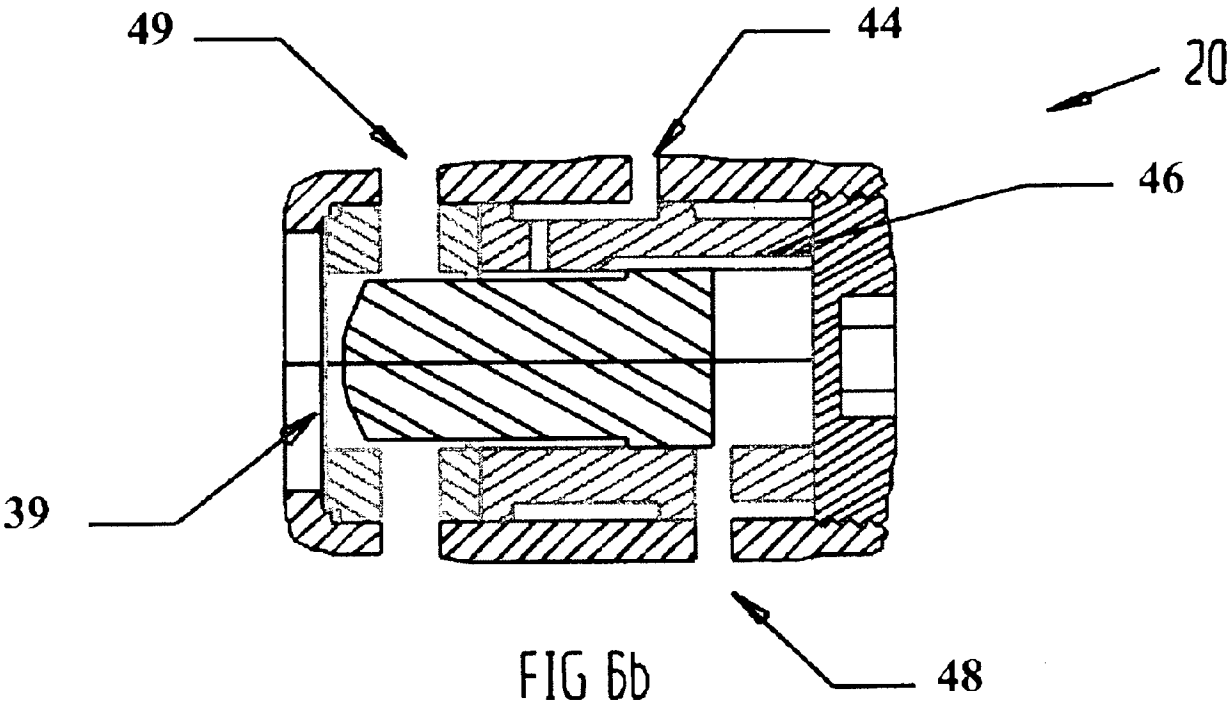
Figure 6C:
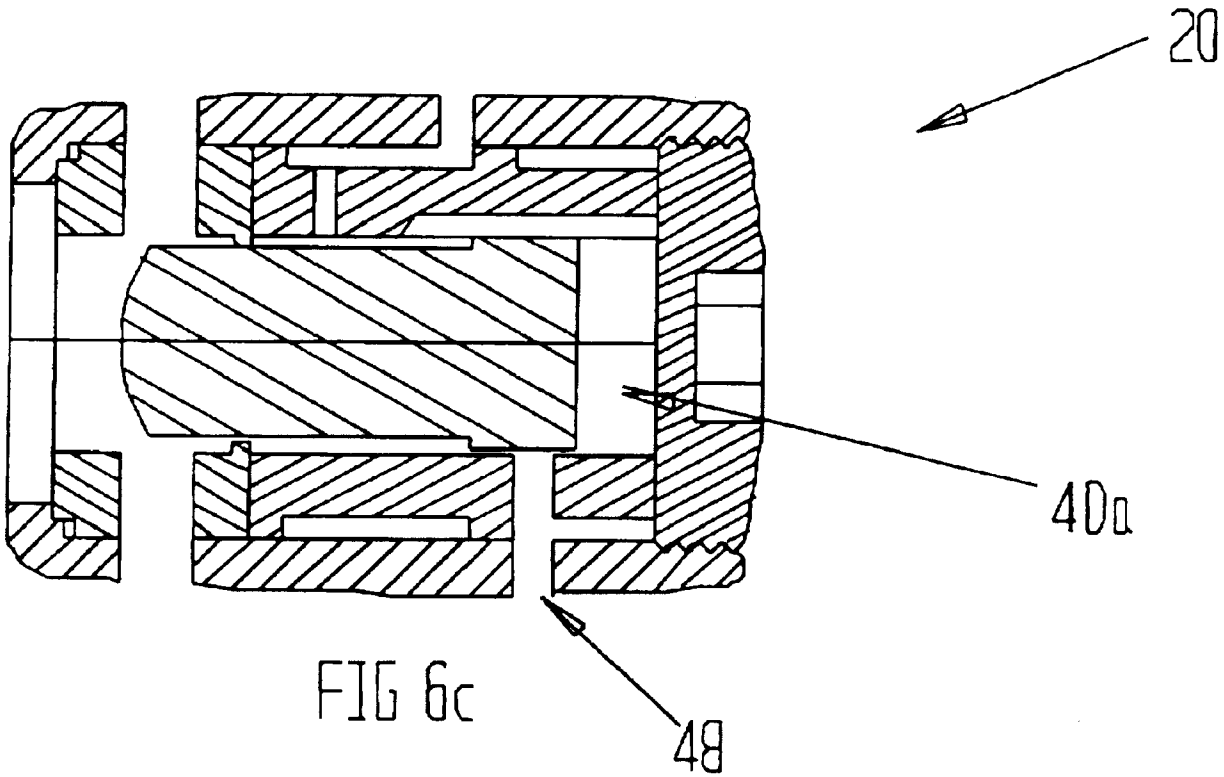
Figure 6D:
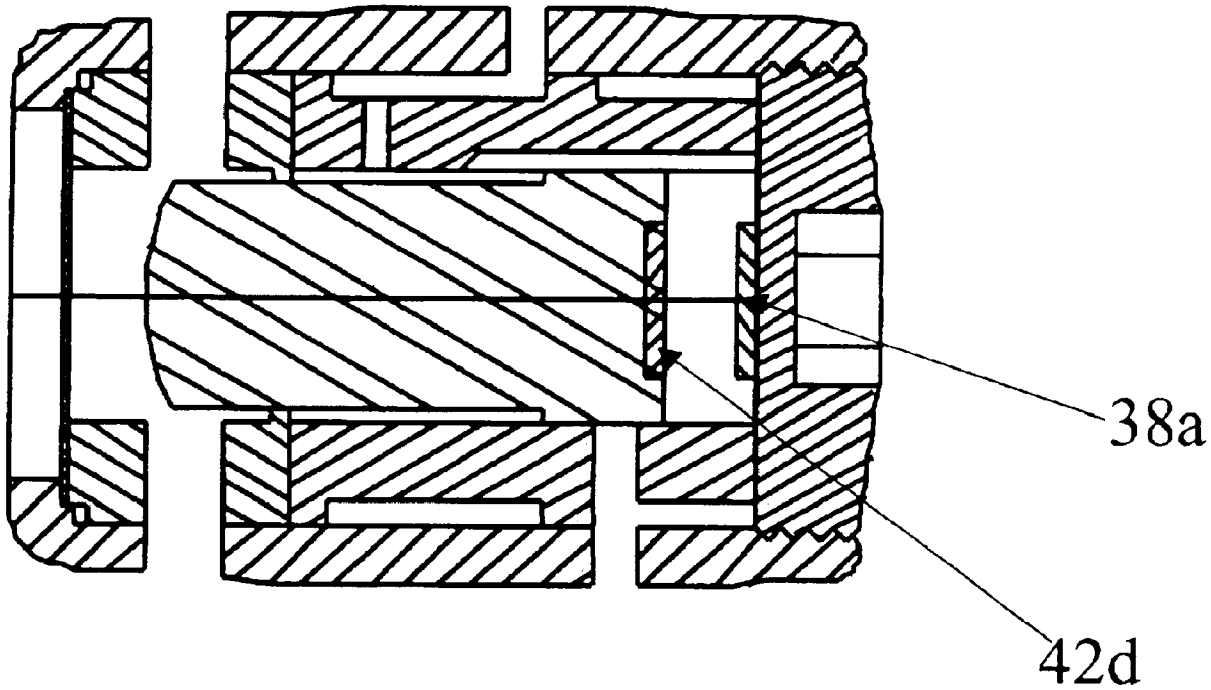
FIG. 6*d* illustrates an alternative configuration of several of the components depicted in FIGS. 6*a*–6*c;*

Stated another way, once the piston 42 has moved from the initial position illustrated in FIG. 6*a* and starts toward the intermediate position illustrated in FIG. 6*b,* the end of groove 46 is uncovered, allowing compressed air to flow through groove 46 and into fluid chamber 40*a*. This allows piston 42 to reach the intermediate position shown in FIG. 6*b*. As the stream of compressed air continues to act against shoulder 45, piston 42 continues to move until it reaches its rearward position, as shown in FIG. 6*c,* wherein the driving end 42*a* of piston 42 completely covers outlet vent 48. As additional compressed air enters fluid chamber 40*a* through groove 46, the pressure in fluid chamber 40*a* builds until it exceeds the pressure exerted by the piston 42. It will be appreciated that the exerted pressure includes both the pressure in fluid chamber 40*b* and the force of the momentum of the piston 42 toward the end wall 36. At this point, the compressed air in fluid chamber 40*a* forces piston 42 to rapidly move toward the opposite, forward end of cylinder 32 until driven end 42*b* of the piston 42 strikes diaphragm 39. This, in turn, creates a percussion wave that is transmitted through the water and "heard" by other divers as an underwater signal. Once the forward movement of piston 42 uncovers outlet vent 48, the pressure in fluid chamber 40*a* is equalized with ambient pressure via outlet vent 48. If additional compressed air is introduced into inlet passageway 44, the piston 42 is driven out of contact with diaphragm 39 toward sleeve 34, repeating the cycle. It will be appreciated that by maintaining a steady flow of compressed air through inlet 44 and groove 46, it is possible to create rapid, periodic impacts of piston 42 against diaphragm 39.

As mentioned above, one of the unique features of the pneumatic signaling device 10 according to the present invention is that the piston 42 of the underwater signal device 20 is both bistable and undamped. In order to fully appreciate the distinction, it would be useful to compare FIGS. 6*a*–6*c* with FIGS. 8*a* and 8*b,* which were taken from U.S. Pat. No. 5,951,205 to Chen. More specifically, the noise making means disclosed by Chen includes a piston 150, an impact member 160, and a cylinder 170. The piston 150 is a substantially T-shape member with a radial bore 152 in its stem. An axial bore 154 is formed between the rear end of piston 150 and the radial bore 152. The piston 150 is reciprocally movable within the cylinder 170. The impact member 160 preferably made by a metal sheet is secured at a front end of the cylinder 170 by a cap 162 which has threads 164 to engage with the body 108. There is a gap 166 between the cap 162, threads 164 and the body 108 for allowing air to discharge outside from the cylinder 170 via an air discharging chamber 172 located between the front end of the cylinder 170 and the impact member 160.

The inside space of the cylinder 170 is divided into three partitions, depending on the position of the piston 150, i.e., the air discharging chamber 172 in the front, a rear chamber 176 behind the piston 150 and a front chamber 174 in the middle portion. The piston 150 is moving air-tight within the cylinder 170, therefore the chambers 172, 174 and 176 do not fluidly communicate with each other directly. Furthermore, there is a third O-ring 179 between the cylinder 170 and the body 108 for preventing air leakage. In a rear portion of the cylinder 170, there is a pair of air channels 177 communicating with the front chamber 174.

Figure 8A:
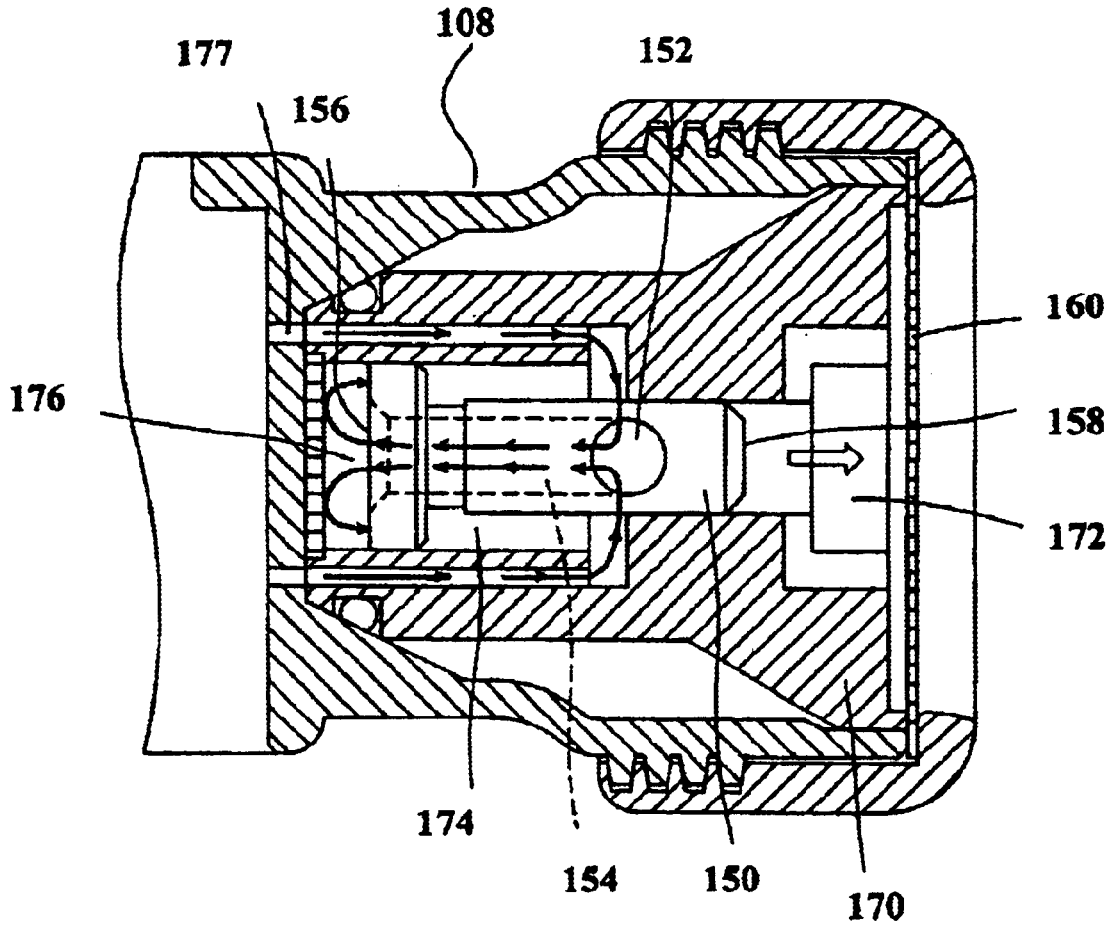
FIG. 8a (Prior Art)
FIGS. 8*a* and 8*b* are first and second sectional views of a known piston operated signaling device at first and second positions, respectively.

Referring to FIG. 8*a,* when in use, compressed air can flow from a source via the air channel 177, radial bore 152 and axial bore 154 into the rear chamber 176 to apply air pressure on the rear end of the piston 150, and thus moves the piston 150 forward. The front end 158 of the piston 150 will hit the impact member 160 for generating audible noise.

Figure 8B:
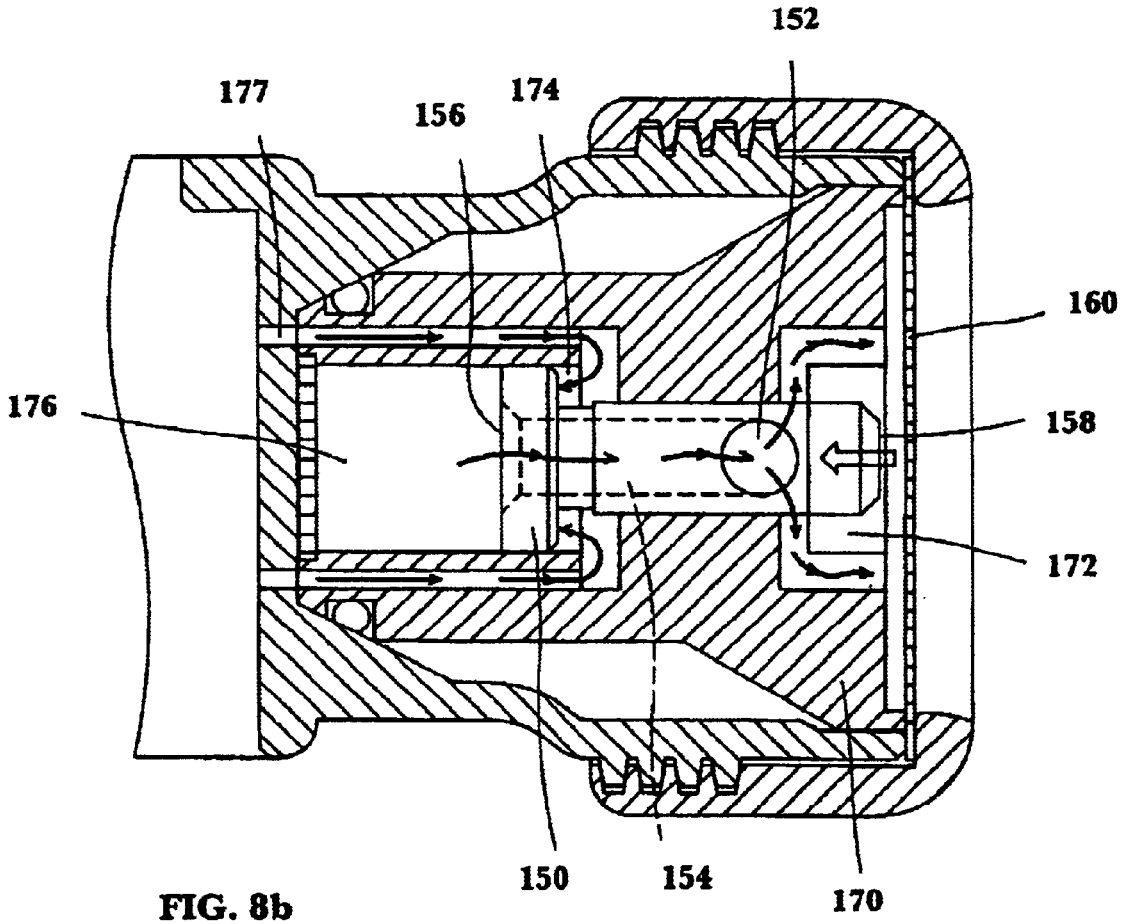
FIG. 8b (Prior Art)

Referring to FIG. 8*b,* when the piston 150 is moved to the front end of the cylinder 170, the radial bore 152 aligns the discharging chamber 172 such that the compressed air in the rear chamber 176 passes to the discharging chamber 172 through the axial bore 154 and the radial bore 152 and is discharged to the outside environment. Thereafter, the air pressure in the rear chamber 166 drops and the radial bore 152 is cut off from compressed air from the air flow path, i.e., the air channel 177. Compressed air then flows into the front chamber 174 via the air channel 177. Compressed air thus moves the piston 150 in a rearward direction to start another cycle of noise making operation. Therefore, when actuating the device continuously, the piston 150 will be actuated to move reciprocally within the cylinder 170 to hit the impact member 160 to generate audible alarm noise desired. As noise is produced by mechanical impact force and means, this invention may be used equally well in the air or in the water.

However, it will be appreciated that the while the piston 150 moves through the cylinder 170, from the position illustrated in FIG. 8*a* to that of FIG. 8*b,* the radial bore 152 is blocked. When this occurs, compressed air is applied to front chamber 174 via air channel 177 at the very moment that the piston 150 is accelerating in the direction of impact member 160. This high pressure cushion of air acts to dampen, i.e., oppose, the motion of piston 150. According to one aspect of the present invention, air flow around the piston 42 rather than through the piston 150 prevents this dampening action from occurring.

It will be appreciated that the operational characteristics of the underwater signaling device 20 can be controlled in a myriad of way, e.g., by adding additional components to the device illustrated in FIGS. 6*a*–6*c*. For example, a pair of magnets 42*d* and 38*a* advantageously can be employed in the signaling device 20. When these magnets are configured North-North or South-South, a magnetic spring is formed. When these magnets are configured North-South or South-North, respectively, the piston 42 will be restrained from moving in the direction of diaphragm 39 until the pressure in portion 40*a* of fluid chamber 40 exceeds the force of attraction between the two magnets. It will be appreciated that other artifices for controlling the operational characteristic of piston 42, e.g., varying the surface area of shoulder 45 or the cross-section of groove 46, will occur to one of ordinary skill in the art and all such artifices are considered to fall within the scope of the present invention.

Figure 5:
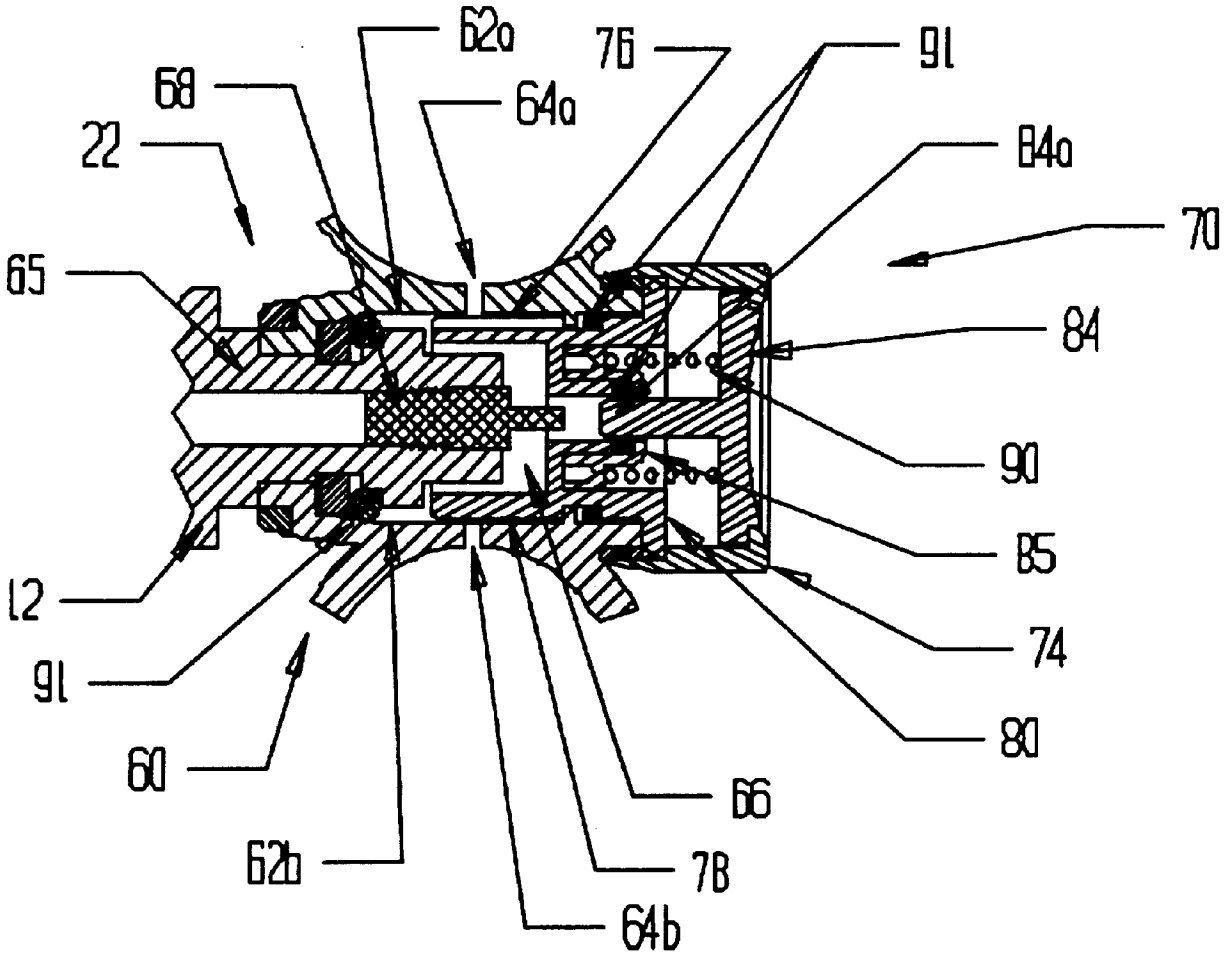
FIG. 5 is partial sectional view of the signaling device of FIG. 1, showing the selector switch housing and quick disconnect body without the air couplings.

Referring now to FIGS. 3*a* and 5, the selector switch and integrated actuator assembly 22 will now be discussed. Actuator assembly 22 includes a housing 60 preferably formed by separate, semi-cylindrical wall portions 62*a* and 62*b*, respectively. When assembled, wall portions 62*a* and 62*b* join each other and form the closed, generally cylindrical housing 60. Wall portion 62*a* may be integrally attached to chamber 23 of component 18. It is, however, considered within the scope of the invention to separately construct and join chamber 23 with wall portion 62*a* of housing 60. When assembled, housing 60 creates an interior space 66. An air flow outlet 64*a* extends through wall portion 62*a* of housing 60 and joins with passageway 29 and opening 30 extending through chamber 23. This series of passageways allows compressed air to flow from interior space 66, through outlet 64*a*, passageway 29 and opening 30 into the interior space formed by horn wall portions 24*a* and 24*b*. In a similar manner, a separate flow outlet 64*b* extends through housing wall portion 62*b* and joins with passageway 44 extending through cylinder 32 and sleeve 34 of underwater signaling component 20. This series of passageways allows compressed air to flow from the interior portion 66, through outlets 64*b* and 44, passageway 46 and into fluid chamber 40 for propelling piston 42 through cylinder 32. It will be appreciated that, in an exemplary case, the flow rate supplied via outlet 64*a* is substantially less than the flow rate supplied via outlet 64*b* by virtue of the relative sizes of the outlets, i.e., orifices, 64*a* and 64*b*. The various portions of the actuator assembly 22 are sealed by o-rings generally denoted 91.

As mentioned above, all-purpose, pneumatic signaling device 10 further includes a quick disconnect body portion 12. Preferably, body portion 12 includes or is coupled to an elongated, hollow sleeve 65 extending within actuator housing 60. A high flow valve 68, which advantageously can accommodate the air flow rate required to operate the underwater signaling component 20, is threaded within sleeve 65, forming a controllable airflow passageway between quick disconnect body 12 and the interior 66 of actuator housing 60.

As shown in FIGS. 4*a* and 5, selector switch 70 is positioned at an opposite end of hollow actuator housing 60 from quick disconnect body 12. Preferably, selector switch 70 includes a radial knob 74 attached for joint rotational movement to a pair of legs 76 and 78 extending from diverter valve 80 and extending within housing 60. It will be appreciated from the other figures that legs 76 and 78 are circumferentially spaced from one another such that when leg 76 blocks adjacent outlet 64*a*, leg 78 cannot block outlet 64*b*.

To operate selector switch 70, it is merely necessary to rotate knob 74 about its longitudinal axis to either first or second predetermined positions. When moved to its first predetermined position, attached legs 76 and 78 rotate about the circumference of wall portion 62*a* until a first slot formed by the legs 76 and 78 is aligned with outlet 64*a* and one of the legs 76 and 78 blocks the opening of flow outlet 64*b*, preventing compressed air from entering the above water signaling component 18. In an exemplary case, when rotation of leg 78 brings it into alignment with outlet 64*b*, outlet 64*b* is covered and, thus, compressed air present in interior space 66 is blocked from entering the underwater component 20 through outlet 64*b*, but is capable of entering the above water signaling component 18 through outlet 64*a* to initiate a above water signal.

When selector knob 74 is rotated to the second predetermined position, attached legs 76 and 78 rotate about the circumference of wall portion 62*b* until a second slot formed by the legs 76 and 78 align with outlet 64*b* and block the opening of outlet 64*a*, preventing compressed air from entering the above water-signaling device 18. In an exemplary but unillustrated case, one of the legs 76 and 78 is aligned with opening 64*a*, preventing compressed air from entering the above water signaling component 18 through inlet opening 64*a*. It is evident that selector switch 70 readily controls actuation of either of the signaling components 18 or 20.

Once selector switch 70 is rotated to either one of its first or second predetermined positions, actuation of the all-purpose signaling device 10 may occur. The actuation assembly includes a button 84 positioned within the cup-shaped portion of radial knob 74 of selector switch 70. A forward end 84*a* of button 84 is aligned with a high flow valve 68. A coil spring 90 is compressed between quick spring pad 85 and button 84.

When actuator button 84 is depressed within the cup portion of radial knob 74, attached button stem 84*a* moves toward the high flow valve 68, causing valve 68 to change from a normally closed position to an open position. Movement of button 84 also functions to compress coil spring 90. When valve 68 reaches its open position, compressed air already flowing through quick disconnect body 12 may flow through valve 68 and enter the interior space 66 within housing 60. Depending on whether selector switch 70 is in its first or second predetermined positions, the compressed air in space 66 will flow through either or the outlets 64*a* or 64*b* and enter one of the signaling components 18 or 20, respectively. This will initiate a signal as long as button 84 remains depressed within selector knob 74. When the pressure is removed from button 84, coiled spring 90 expands to slide button stem 84*a* away from high flow valve 68. This advantageously permits high flow valve 68 to close and block the flow of compressed air from quick disconnect body 12 from entering interior space 66, thus ending the signal.

Thus, the pneumatic signaling device according to the present invention advantageously can be used to signal other divers both above and below the water. Preferably, the pneumatic signaling device employs only one activator button to deliver air under pressure to a selected one of the surface signaling element or the underwater signaling element. It will be appreciated that the selection function, which permits the diver to determine whether the activated device is the above water or below water signaling device, can be either a flow path selection device or a flow rate selection device. The inventive, all-purpose pneumatic signaling device includes an underwater signaling device that has only one moving part, e.g., a bi-stable undamped piston that oscillates in response to application of a relatively high (high with respect to that needed to operate a pneumatic horn) volume of air. It will be appreciated that the piston is undamped by virtue of the pressure equalization path around the driving end of the piston.

Figure 7:
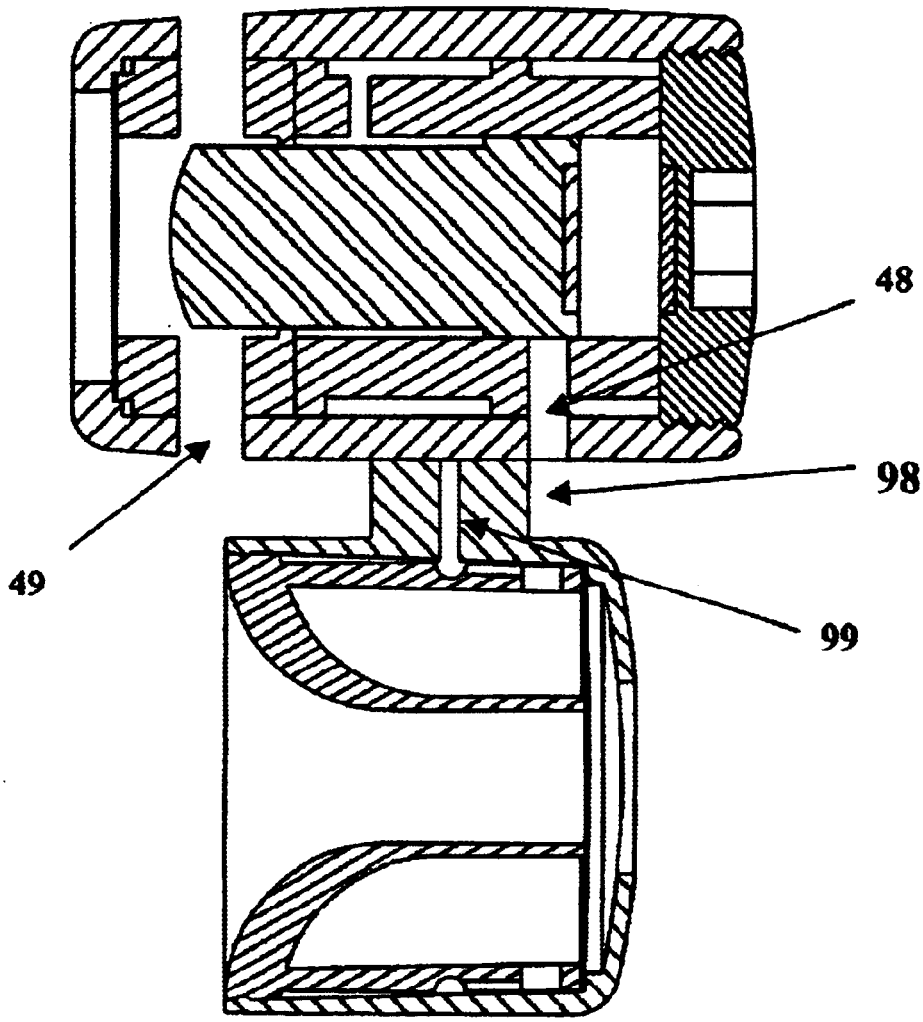
FIGS. 7 illustrates an alternative embodiment of the pneumatic signaling device according to the present invention.

FIG. 7 illustrates an alternate exemplary embodiment of the pneumatic signaling device 10 according to the present invention. More specifically, the above water signaling device 18 is slideably coupled to the underwater signaling device 20 via a support member 98, which advantageously includes a restricting orifice 99. It will be appreciated that the orifice 99 is permanently aligned with and connected to the inlet port (opening) 30. It will also be appreciated that the orifice 99 of support member 98 proximate to signaling device 18 is sized to permit air at a first flowrate to enter signaling device 18. Thus, when the orifice 99 is aligned with outlet port 48 of the underwater signaling device 20, only the first flowrate is available to both the signaling devices 18 and 20. Since the first flowrate is sufficient to operate signaling device 18 but insufficient to operate signaling device 20, only signaling device will produce the desired signal. In order to operate the underwater signaling device 20, a second flowrate of air can be selected by, for example, sliding the support member 98 toward the diaphragm 39.

It should be mention that one of ordinary skill in the art can easily determine multiple arrangements of mechanical elements by which one of the first and second flowrates advantageously can be selected. For example, a portion of the support member 98 can be machined with an open "T" to accept a corresponding "T-shaped" protrusion attached to the cylinder 32, thus allowing the signaling device 18 to slide with respect to the signaling device 20. The "T" shape is only exemplary case, since rivets and corresponding slots or even dove tailing advantageously can be employed to permit the signaling devices 18 and 20 to move relative to one another. Alternatively, the support member 98 can be connected to the underwater signaling device 20 by a pin, which permits the above water signaling device 18 to be rotated between first and second positions. In the first position, the port 48 vents to the environment; in the second position, ports 48 and 30 are coupled to one another by orifice 99. Thus, rotating the abovewater signaling device 18 between first and second positions selects between first and second flowrates. Other mechanical arrangements, e.g., spool valves, slide valves, concentric rings, etc., can all be made to perform the flowrate selection function discussed above, and all such variations are considered to be within the scope of the present invention.

Two points need to be mentioned in connection with FIG. 7. First, it will be noted that use of the selection mechanism illustrated in FIG. 7 permits the simplification of the pneumatic signaling device 10, since the selection function need not be performed upstream of the signaling devices 18 and 20. Second, in the illustrated embodiment of FIG. 7, the effective orifice size of port 49 remains constant irrespective of whether the first or second flowrate is actually selected. As mentioned above, the air exhausting via port 49 is due to air leaking between the driven end 42*b* of piston 42 and the bearing surface 41*a* of bushing 41, i.e., the flowrate can be treated as being de minimus. It will be appreciated that the port 49 can be one of closed off or coupled to port 30 when the abovewater signaling device 18 is selected for operation. For example, the ports 48 and 49 advantageously can be pneumatically coupled via a port equalization slot scribed in the outer surfaces of the sleeve 34 and bushing 41 between ports 48 and 49.

Thus, the present invention has been described herein with reference to particular advantageous embodiments for a particular application. Those having ordinary skill in the art and access to the present teachings will recognize additional modifications, applications, and embodiments within the scope thereof. While the present invention is adaptable for use with the existing compressed air system employed by scuba divers, it could also be used with any source of compressed air. Skin divers may readily employ the signaling device of the present invention when directly attached to a compressed air container carried with the device or worn by the diver. Likewise, while a bell horn is employed as the above water-signaling component, any air driven device may be substituted for the horn. While the selector switch 70 is described as having only first and second predetermined settings related to above and below water signaling devices, it is within the scope of the present invention to have additional settings such as a third or neutral setting. During operation, the selector switch 70 initially maintained in the neutral setting may be rotated to either the first or second predetermined settings. When the signal is terminated, the selector switch 70 is returned to the neutral position.

It is therefore intended by the appended claims to cover any and all such applications, modifications and embodiments within the scope of the present invention.

What is claimed:

1. A pneumatic signaling device operable above and below the surface of the water from a source of compressed gas, comprising:

a continuous signaling device including an air horn that generates a continuous signal detectable above the surface of the water and that operates at a first flowrate;

a percussion signaling device including a bi-stable undamped piston that generates an intermittent signal detectable below the surface of the water and that operates at a second flowrate greater than the first flowrate; and a pneumatic selector switch that selects between first and second orifices sized to produce the first and second flowrates, respectively.

2. An all-purpose signaling device operable above and below the surface of the water from a source of compressed gas, comprising:

a first signaling component including a gas driven horn that transmits audible sounds above water, which first signaling component is operable at a first flowrate;

a second signaling component comprising a cylinder including a longitudinal bore accepting a bi-stable piston and a diaphragm disposed across an open end of the longitudinal bore for creating a percussion wave signal that travels underwater, which second signaling component is operable at a second flowrate;

a selector switch assembly for selectively creating one of first and second flow passageways sized to permit flow of the compressed gas at one of the first and second flowrates to one of the first and second signaling components, respectively; and an actuator which provides the compressed gas to the selector switch.

3. The all-purpose signaling device according to claim 2, wherein:

the piston includes a driven end which impacts the diaphragm and a driving end opposite the driven end;

the driving end of the piston is larger in diameter than the driven end of the piston;

the cylinder includes an inlet port and an exhaust port disposed on opposite sides of the driving end of the piston; and movement of the driving end of the piston away from the diaphragm between first and second predetermined positions simultaneously closes the exhaust port in the cylinder to thereby permit pressure buildup proximate to the driving end of the piston and opens a bypass passageway permitting the compressed gas from the inlet port to contribute to the pressure buildup.

4. The all-purpose signaling device according to claim 2, wherein the selector switch assembly includes first and second members, opposing edges of which define first and second slots, disposed for joint rotation about a common axis, wherein one of the first and second members is positioned adjacent a first flow inlet of one of the first and second signaling components when the first and second members are rotated to a first predetermined position and wherein one of the first and second members is positioned adjacent a second flow inlet of the other of the first and second signaling components when the first and second members are rotated to a second predetermined position.

5. The all-purpose signaling device according to claim 4, wherein the first slot is positioned adjacent to the first flow inlet of one of the first and second signaling components when the first and second members are rotated to a first predetermined position and wherein the second slot is positioned adjacent to the second flow inlet of the other of the first and second signaling components when the first and second members are rotated to the second predetermined position.

6. The all-purpose signaling device according to claim 2, wherein:

movement of the selector switch assembly between first and second positions selectively creates one of the first and the second flow passageways, respectively; and the actuator is operable irrespective of whether the selector switch assembly is the first position or the second position.

7. A pneumatic signaling device operable by compressed gas, comprising:

a continuous signaling device includes a gas driven horn operable at a first flowrate of the compressed gas, a percussion signaling device including a single bi-stable piston operable at a second flowrate of the compressed gas greater than the first flowrate; and a control device including a moveable member which permits operation of a selected one of the continuous signaling device and the percussion signaling device;

wherein:

wherein the bi-stable piston is disposed in a cylinder providing air passageways permitting undamped operation of the bi-stable piston; and movement of the moveable member between first and second positions selects between the first and second flowrates required to operate the continuous and the percussion signaling devices, respectively, while positioning the moveable member to a third position establishes the selected one of the first and second flowrates.

8. The pneumatic signaling device according to claim 7, wherein the moveable member is rotatable between the first and second positions.

9. The pneumatic signaling device according to claim 7, wherein the moveable member permits movement to the third position irrespective of whether the moveable member starts from the first position or the second position.

10. A percussion signaling device operable underwater from a source of compressed gas, comprising:

a bi-stable piston;

a cylinder including a longitudinal bore accepting the bi-stable piston; and a diaphragm disposed across an open end of the longitudinal bore, wherein movement of the bi-stable piston into contact with the diaphragm responsive application of compressed gas to the bi-stable piston creates a percussion wave signal that travels underwater.

11. The percussion signaling device according to claim 10, wherein:

the piston includes a driven end which impacts the diaphragm and a driving end opposite the driven end;

the driving end of the piston is larger in diameter than the driven end of the piston;

the cylinder includes an inlet port and an exhaust port disposed on opposite sides of the driving end of the piston; and movement of the driving end of the piston away from the diaphragm between first and second predetermined positions simultaneously closes the exhaust port in the cylinder to thereby permit pressure buildup proximate to the driving end of the piston and opens a bypass passageway permitting the compressed gas from the inlet port to contribute to the pressure buildup.

12. The percussion signaling device according to claim 10, further comprising a magnetic spring means for varying an operational characteristic of the movement of the bi-stable piston relative to the longitudinal bore.

13. The percussion signaling device according to claim 10, further comprising a magnetic retainer means for varying an operational characteristic of the movement of the bi-stable piston relative to the longitudinal bore.

14. The percussion signaling device according to claim 10, further comprising means for varying an operational characteristic of the movement of the bi-stable piston relative to the longitudinal bore.

* * * * *